United States Patent [19]

Scoggin, Jr. et al.

[11] 4,007,510

[45] Feb. 15, 1977

[54] BRUSH HEAD

[75] Inventors: Baxter I. Scoggin, Jr., Kansas City; Woodrow E. Vaughan; Gerald D. Reed, both of Independence; Don W. Cartner, Kansas City, all of Mo.; David E. Hill; Jack E. Briar, both of Gardner, Kans.

[73] Assignee: Modern Plastic Sales, Independence, Mo.

[22] Filed: July 9, 1975

[21] Appl. No.: 594,338

[52] U.S. Cl. ..... 15/176; 15/159 A; 15/231

[51] Int. Cl.[2] ..... A46B 7/04; A46B 9/02

[58] Field of Search ..... 15/159 A, 160, 231, 15/232, 176; 132/76.5

[56] References Cited

UNITED STATES PATENTS

| | | | |
|---|---|---|---|
| 178,594 | 6/1876 | Burrington | 15/231 |
| 2,654,927 | 10/1953 | Tansman | 15/231 U X |
| 3,421,171 | 1/1969 | Tsuruzawa | 15/172 |
| 3,631,562 | 1/1972 | Kieves | 15/172 |
| 3,747,152 | 7/1973 | Tsuruzawa | 15/160 X |
| 3,750,224 | 8/1973 | Krusche | 15/231 |
| 3,828,386 | 8/1974 | Roth | 15/105 |
| 3,833,962 | 9/1974 | Krusche | 15/231 X |
| 3,965,520 | 6/1976 | Maier | 15/104.94 |

*Primary Examiner*—Daniel Blum
*Attorney, Agent, or Firm*—Schmidt, Johnson, Hovey & Williams

[57] ABSTRACT

A carpet care tool beautifies, fluffs and cleans carpet fibers by brushing its relatively short, densely disposed and uniformly slanted filaments against the carpet fibers in one direction as the tool is drawn in a sweeping stroke in pressing engagement with the carpet. Pushing the tool in the opposite direction while pressed against the carpet quickly dislodges the entrapped foreign matter such as lint, hairs, threads and dust particles so they can be quite easily picked up and discarded. The specially contoured brushing head, together with its resilient padding arrangement to give uniform deflection over the entire working surface of the head, plus trilobed slanted filaments of the brush fabric itself, all cooperate to provide a well-groomed, beautifully finished carpet appearance not possible with mere vacuuming techniques.

8 Claims, 7 Drawing Figures

BRUSH HEAD

This invention relates to a carpet grooming tool that beautifies and prolongs the life of fine carpets and the like by fluffing the carpet fibers and picking up and removing foreign matter such as pet hairs, lint, thread and dust that is practically impossible to remove with conventional vacuum cleaners. More particularly, this invention relates to a relatively simple, yet extremely effective tool that accomplishes the desired meticulous cleaning and healthful grooming through a mere brushing action applied by the user.

Certain garment delinting tools heretofore available have utilized a special fabric having relatively short, densely disposed filaments uniformly slanted in one direction so that when the tool is stroked in that direction, the filaments lift the foreign matter and temporarily hold it within the depths of the filaments. Reversing the direction of stroking on a separate cloth causes the filaments to release the entrapped material so that the tool is rendered clean for the next delinting stroke. One tool utilizing this type of fabric is shown, for example, in U.S. Pat. No. 3,421,171.

While garment delinters using slanted filament fabrics have apparently been relatively successful in their limited fields of use, they have not and cannot be applied with success to carpet beautification and maintenance because of design deficiencies in the shapes of their brushing heads, in the nature and extent of backup cushions for the brushing fabric, and in the character of the brushing fabric itself. These defects prevent the tools from exhibiting the high degree of uniform and positive control needed over foreign matter when engaged by the filaments, causing inconsistent cleaning action on a hit-and-miss basis at best.

It is, therefore, an important object of the present invention to provide a carpet care tool which, for the first time, successfully incorporates a short, uniformly slanted filament type brushing fabric that aggressively, thoroughly and consistently fluffs carpet fibers and extracts deleterious foreign matter therefrom with but a quick and easy stroking action.

Another important object of the present invention is to provide for such beautification even in normally hard-to-maintain areas such as along baseboards, in corners, on carpet risers, and on stair treads.

An additional object is to provide a grooming tool designed to take good advantage of and work in complete harmony with a natural drawing stroke normally employed when sweeping, raking or mopping.

Figure 1:
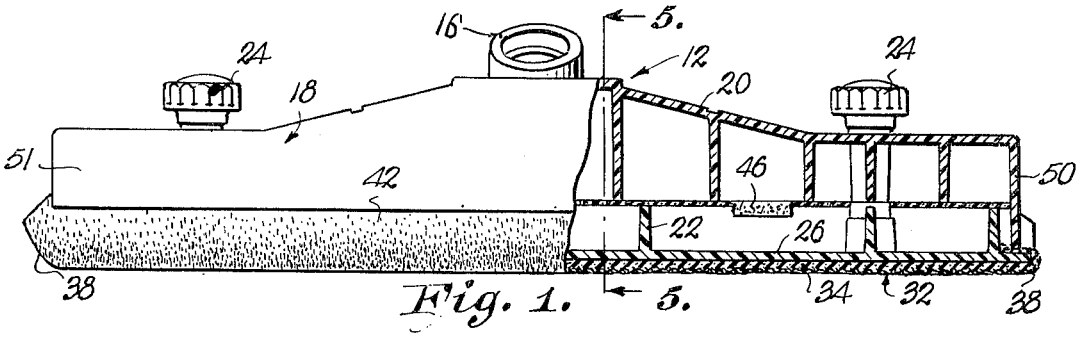
FIG. 1 is a side elevational view of the head of a grooming tool constructed in accordance with the teachings of the present invention, portions of the head being broken away to reveal details of construction.

Basic components of the tool 10 include a grooming head 12 and a long handle 14 (fragmentarily shown) threaded into an angularly disposed socket 16 on the part of head 12. The latter has a hollow support 18, generally rectangular in configuration with its longitudinal axis transverse to that of handle 14, which is divided into an upper section 20 and a lower section 22. Sections 20 and 22 are releasably interconnected by a pair of normally upright thumbscrews 24 disposed on opposite sides of handle 14.

Figure 5:
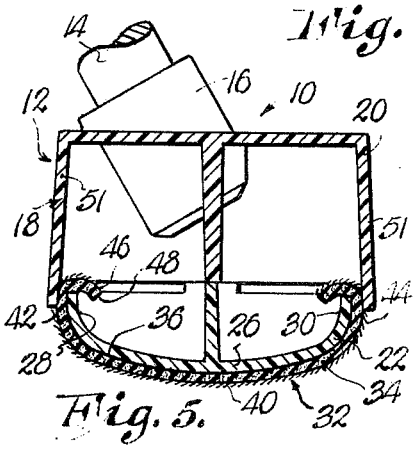
FIG. 5 is a slightly enlarged cross-sectional view through the head with a handle attached and taken along line 5—5 of FIG. 1.

Upper section 20 is slightly trapezoidal in transverse cross section as illustrated in FIG. 5, while lower section 22 is transversely arcuate in cross-section as shown in FIG. 5. Section 22 is concave upwardly, and its broad central portion 26 has a gentle curvature of uniform radius from one longitudinal marginal portion 28 thereof to its opposite longitudinal marginal portion 30. Each marginal portion 28, 30 is also transversely curved but is of substantially smaller radius than central portion 26.

Figure 2:
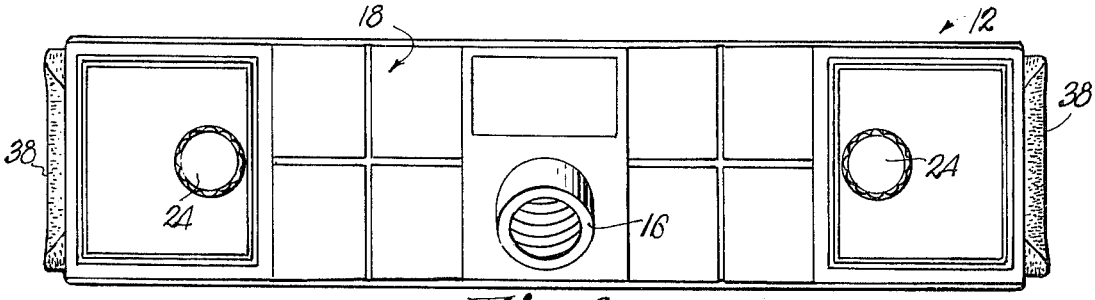
FIG. 2 is a top plan view thereof.
Figure 3:
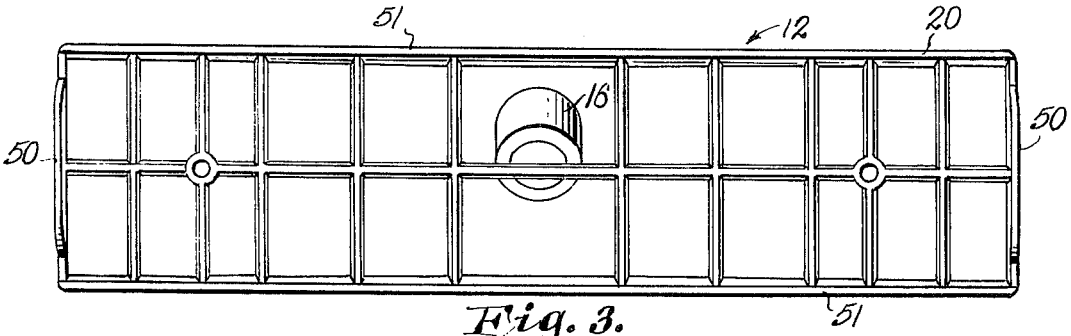
FIG. 3 is a bottom plan view of the upper, detachable half of the head.

As illustrated best in FIG. 5, lower section 22 is slightly narrower than upper section 20 adjacent the lower extremity of the latter so that sections 20, 22 are disposed in relatively telescoped relationship with one another, forming in effect a tongue-and-groove joint all along the interface between the terminal ends of section 20 and the marginal portions 28, 30 of section 22. The fact that upper section 20 is shorter than lower section 22 causes the latter to extend beyond the opposite ends of section 20 as illustrated in FIGS. 1 and 2. Note also in FIG. 6 the tongue-and-groove relationship between sections 20, 22 as viewed from one end of tool 10.

The specially contoured lower section 22 serves as a rigid backup panel for brush 32 (detailed in FIG. 7) and its backup pad 34 of resilient elastomeric material such as polyurethane foam. Pad 34 is, of course, disposed between brush 32 and section 22 and is bonded to the latter throughout its width and length with a suitable adhesive 36. Similarly, the brush 32 is adhesively bonded to the pad 34 by a suitable agent (not shown).

Brush 32 and pad 34 follow the contour of support section 22 and, therefore, the brush 32 is rendered generally rectangular in configuration while having a rectilinear longitudinal axis between its opposed transverse marginal edges 38 as shown best in FIG. 1. The configuration of section 22 also renders brush 32 transversely arcuate with its radius of curvature being uniform throughout the working surface 40 thereof corresponding to the central portion 26 of section 22. The opposed longitudinally extending marginal edges 42 and 44 brush 32, corresponding to the marginal portions 28 and 30 of section 22, are also arcuate but have substantially smaller radii of curvature than working surface 40.

Figure 4:
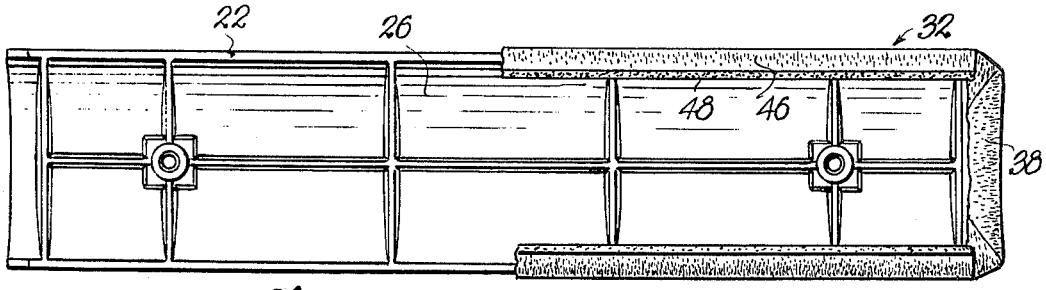
FIG. 4 is a top plan view of the bottom detachable half of the head illustrating fragmentarily the manner in which the brush and its backup pad are curled over the edges and ends of such lower half.

As illustrated, brush 32 and pad 34 are coextensive in length and width with the section 22 but, as shown in FIGS. 4 and 5, the peripheries 46 and 48 of brush 32 and pad 34 overlap the tops of marginal portions 28, 30 of section 22, thereby enabling such peripheries 46, 48 to be tightly clamped between sections 20, 22 by thumbscrews 24. As illustrated well in the Figures, marginal edges 38, 42 and 44 of brush 32 are all fully exposed, and each transverse marginal edge 38, by virtue of the overhang in section 22, itself overhangs beyond the corresponding proximal end wall 50 of upper section 20. The sidewalls 51 of upper section 20 partially overlap corresponding proximal edges 42, 44 of brush 32.

Figure 7:
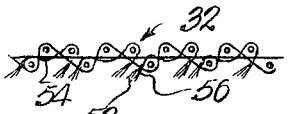
FIG. 7 is an enlarged, fragmentary detail view of the brush illustrating the slant or slope of the trapping filaments.

As illustrated best in FIGS. 5 and 7, the brush 32 has a linear arrangement of ridges 52 and valleys 54 disposed in parallelism with longitudinal edges 42, 44 of brush 32. Each ridge 52 comprises a continuous series of relatively stiff, short, densely disposed filaments 56 sloping toward edge 42. Preferably, brush 32 is a trilobal nylon fabric such as that manufactured and sold by the E. I. DuPont De Nemours & Co., Inc., of Wilmington, Delaware, under the trademark ANTRON.

Figure 6:
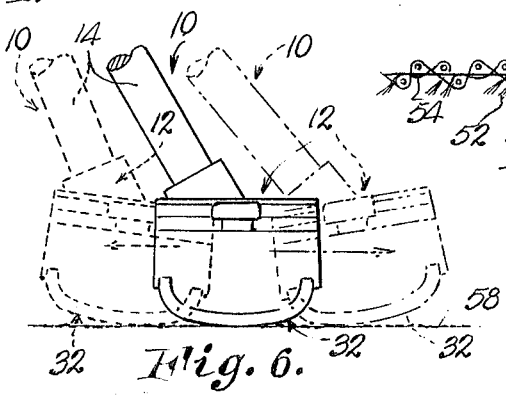
FIG. 6 is a diagrammatic view of the tool on a reduced scale illustrating its manner of usage.

When the head 10 is initially engaged with the carpet 58 to be cleaned, the tool 10 is held at a distance from the user in the angular orientation shown in the rightmost phantom position of FIG. 6 wherein the working surface 40 adjacent marginal edge 42 of brush 32 is in primary engagement with the carpet 58. As the tool is then pressed against carpet 58 and drawn toward the user in a light sweeping action, head 12 is rocked toward and beyond a generally level condition illustrated in solid lines in FIG. 6 until head 12 is close to the user and tipped back toward the opposite part of working surface 40 most adjacent the marginal edge 44 as shown in the leftmost phantom view of FIG. 6. The trilobed filaments 56 of brush 32 act like thousands of tiny fingers during this rocking motion to progressively reach into the carpet fibers, grasp the foreign matter such as hair, threads, lint and dust particles, and entrap such matter deeply within the valleys 54 so that any matter once picked up by filaments 56 is not again released until head 12 is purposely shifted in the opposite direction against a disposable cloth of suitable nature.

It is important to recognize that the longitudinally flat nature of brush 32 between its opposite transverse edges 38 means that the full length of brush 32 will remain in forceful engagement with the carpet fibers during the draw stroke. Even adjacent transverse edges 38, where the pressing force applied through handle 14 can be expected to be somewhat less than that applied near the center of brush 32, the filaments 56 are maintained in contact with the carpet fibers. Hence, consistent and uniform cleaning is obtained from end-to-end of head 12 without leaving spotty areas or streaks of incomplete fluffing and cleaning.

Equally as important is the fact that the resilient cushioning provided by pad 34 is uniform throughout the entire working surface 40 of brush 32. This is essential if foreign matter once engaged by filaments 56 is to be completely entrapped thereby until intentionally released in a push stroke. If, for example, the pad 34 were to progressively diminish in thickness as marginal edges 42 and 44 were approached, the tendency would be for those filaments 56 most adjacent edges 42 and 44 to have reduced entrapping ability compared with those filaments 56 located toward the center of working surface 40. Hence, matter engaged at the beginning and end of the drawing stroke, although initially grasped by filaments 56, would have a tendency to be more easily and unintentionally dislodged.

In this same respect, having pad 34 of uniform thickness from end-to-end of head 12 between transverse edges 38 of brush 32, assures that foreign matter will be tenaciously entrapped by even those filaments 56 most adjacent transverse edges 38. The tendency, then, for any streaks of matter to be left behind in those areas is completely avoided and proper fluffing of the carpet fibers is accomplished over the entire length of head 12.

It has been found after careful analysis to determine the degree of resiliency and extent of deflection of brush 32 which gives the most tenacious trapping action on the part of filaments 56 that pad 34 should be approximately 3/16 inches thick and have a compression strength of (at 10% deflection) approximately 20 pounds per square inch. When pad 34 is given these characteristics and is shaped and arranged in the manner above described, very little if any foreign matter ever escapes the aggressive action of filaments 56.

Also having a substantial bearing on the high degree of effectiveness of the tool 10 is the uniformly transversely arcuate configuration of the brush 32 over its entire working surface 40. Its gentle radius of curvature is well suited to the normal type of drawing or sweeping stroke to which the user may be accustomed, it being substantially the same as employed during sweeping, raking or mopping. Inasmuch as the head 12 is inherently rocked during the drawing stroke, the gentle but uniform curvature of brush 32 assures that a multitude of the ridges 52 and their filaments 56 are held against the carpet throughout the entire drawing stroke. With the working surface 40 made perfectly flat, the rocking action would tend to yield only edge or line contact between brush 32 and the carpet at the beginning of the drawing stroke and would give full surface contact only at the completion of the stroke when the head 12 was closest to the user.

Moreover, having a flat surface abruptly joined by right-angle sides instead of having a gently curved surface 40 approached smoothly by arcuate marginal edges 42 and 44 would have a dentrimental effect on the resistance to deflection of brush 32 at edges 42 and 44 which would, of course, adversely affect the cleaning and fluffing ability of brush 32 as hereinabove explained. Thus, the curvatures of working surface 40 and marginal edges 42 and 44 are important and do cooperate in a significant way with other features of head 12 to provide the degree of beautification desired.

The specific nature of brush 32 utilized on head 12 also contributes substantially to proper pickup and entrapment of foreign matter. In this respect it has been found that the trilobal nature of filaments 56 is particularly valuable and, when combined with other features such as the uniformly transversely arcuate configuration of working surface 40, the degree and extent of its deflection when pressed against the carpet, and the longitudinally flat character of brush 32 between its transverse marginal edges 38, the total effect is to produce a tool having outstanding carpet grooming attributes.

Significant also is the fact that all marginal edges 38, 42 and 44 of brush 32 are fully exposed such that head 12 may be quite readily employed in normally hard to maintain areas of the carpet. For example, in sharp corners and along baseboards, it would be difficult to groom the carpet fibers immediately adjacent such structures were it not for the full exposure of filaments 56 about the entire periphery of the head 12. Even on carpeted stair treads where a variety of angles are encountered, the head 12 performs admirably.

In the unlikely event that brush 32 should exhibit an inordinate amount of wear so that filaments 56 become too short at least in certain areas to accomplish their intended function, the construction of head 12 facilitates ready removal and replacement of the worn parts. By simply loosening the thumbscrews 24, the entire lower section 22, together with pad 34 and brush 32, may be removed and discarded whereupon a fresh replacement unit may be mounted in the vacated position between and below walls 50 and 51 of upper section 20. It is then only necessary to retighten thumbscrews 34, whereupon the tool 10 is once again in perfect condition to continue its carpet beautification treatment.

Having thus described the invention, what is claimed as new and desired to be secured by Letters Patent is:

1. A tool for removing foreign matter from material to be cleaned, said tool including:

a head provided with a rectangular brush having a rectilinear longitudinal axis, said brush having:

a pair of opposed, transverse marginal edges, a first longitudinally extending marginal edge, a second longitudinally extending marginal edge, a linear arrangement of ridges and valleys in parallelism with said longitudinal edges, a transversely convex configuration, a compressible, resilient, convex backup pad, each ridge comprising a continuous series of relatively stiff, short, densely disposed filaments sloping toward said first longitudinal edge whereby, when the brush is pulled in one direction with said first longitudinal edge leading, while the brush is held in pressing engagement with said material, the foreign matter is picked up by the filaments, and when the brush is pushed in the opposite direction with the second longitudinal edge leading, while the brush is held in pressing engagement with said material, the foreign matter is dislodged from the filaments, and an elongated, rigid backup panel for the pad, said panel being transversely convex to the same degree as the pad from said first longitudinal marginal edge to said second longitudinal marginal edge of the brush, said pad and brush being of uniform thickness throughout the entire curvature of said panel.

2. The invention of claim 1; and a support for said brush having side and end walls, each transverse edge extending outwardly as an overhang beyond its corresponding proximal end wall.

3. The invention of claim 2, said support having a pair of releasably interconnected sections, the brush and the pad being mounted on one of said sections.

4. The invention of claim 3, said brush and said pad being clamped throughout their peripheries between said sections.

5. A tool for removing foreign matter from material to be cleaned, said tool including:

a head provided with a rectangular brush having a rectiliner longitudinal axis, said brush having:

a pair of opposed, transverse marginal edges, a first longitudinally extending marginal edge, a second longitudinally extending marginal edge, a linear arrangement of ridges and valleys in parallelism with said longitudinal edges, a resilient backup pad, and a transversely arcuate configuration, each ridge comprising a continuous series of relatively stiff, short, densely disposed filaments sloping toward said first longitudinal edge whereby, when the brush is pulled in one direction with said first longitudinal edge leading, while the brush is held in pressing engagement with said material, the foreign matter is picked up by the filaments, and when the brush is pushed in the opposite direction with the second longitudinal edge leading, while the brush is held in pressing engagement with said material, the foreign matter is dislodged from the filaments, the curvature of said arcuate configuration being uniform between said longitudinal edges whereby, as the brush is rocked transversely thereof during the push-pull operation, a multitude of said ridges is held against the material throughout their lengths, all of said marginal edges being fully exposed for operational effectiveness during use of the tool; and a support for said brush having side and end walls, each transverse edge extending outwardly as an overhang beyond its corresponding proximal end wall, said support having a pair of releasably interconnected sections, the brush and the pad being mounted on one of said sections, said brush and said pad being clamped throughout their peripheries between said sections, the pad being adhesively bonded throughout to said one section, the brush being adhesively bonded throughout to said pad.

6. The invention of claim 5, said one section having a rigid backup panel for said pad, the brush, the pad and the panel being substantially coextensive in length and width.

7. The invention of claim 6, said sections being hollow and telescoped one within the other, said sidewalls partially overlapping corresponding proximal longitudinal edges of the brush.

8. The invention of claim 7, there being a tongue and groove joint between the sections at said opposite end walls thereof, respectively, the brush and the pad extending into the grooves throughout the lengths of the latter.

* * * * *